US011832780B2

(12) United States Patent
Amaral et al.

(10) Patent No.: US 11,832,780 B2
(45) Date of Patent: Dec. 5, 2023

(54) MOBILE CLEANING ROBOT DUSTPAN

(71) Applicant: iRobot Corporation, Bedford, MA (US)

(72) Inventors: Erik Amaral, Bolton, MA (US); Timothy R. Ohm, Grover Beach, CA (US); Andrew Deschenes, Arlington, MA (US)

(73) Assignee: iRobot Corporation, Bedford, MA (US)

( * ) Notice: Subject to any disclaimer, the term of this patent is extended or adjusted under 35 U.S.C. 154(b) by 82 days.

(21) Appl. No.: 17/388,302

(22) Filed: Jul. 29, 2021

(65) Prior Publication Data

US 2023/0031127 A1 Feb. 2, 2023

(51) Int. Cl.

| | |
|---|---|
| ***A47L 9/06*** | (2006.01) |
| ***A47L 9/04*** | (2006.01) |
| ***A47L 9/28*** | (2006.01) |

(52) U.S. Cl.

CPC ..... *A47L 9/064* (2013.01); *A47L 9/0477* (2013.01); *A47L 9/2847* (2013.01); *A47L 9/2852* (2013.01); *A47L 2201/04* (2013.01); *A47L 2201/06* (2013.01)

(58) Field of Classification Search

CPC ..... A47L 9/064; A47L 9/0477; A47L 9/2847; A47L 9/2852; A47L 2201/04; A47L 2201/06; A47L 11/4013; A47L 11/4041; A47L 11/4044; A47L 11/282; A47L 2201/00

See application file for complete search history.

(56) References Cited

U.S. PATENT DOCUMENTS

| | | | | |
|---|---|---|---|---|
| 7,318,248 | B1 * | 1/2008 | Yan | A47L 11/4061 15/340.1 |
| 8,732,897 | B2 * | 5/2014 | Jung | A47L 9/0466 15/93.1 |
| 8,739,355 | B2 * | 6/2014 | Morse | A47L 11/4041 15/340.1 |
| 2005/0229340 | A1 * | 10/2005 | Sawalski | A47L 11/4013 15/52.1 |
| 2020/0275812 | A1 | 9/2020 | Burbank et al. | |

FOREIGN PATENT DOCUMENTS

| | | |
|---|---|---|
| DE | 10242257 | 4/2003 |
| EP | 2443978 | 4/2012 |
| EP | 2689701 | 1/2014 |
| WO | 2014187499 | 11/2014 |

OTHER PUBLICATIONS

"International Application Serial No. PCT US2022 036635, International Search Report dated Oct. 24, 2022", 4 pgs.
"International Application Serial No. PCT US2022 036635, Written Opinion dated Oct. 24, 2022", 6 pgs.

* cited by examiner

*Primary Examiner* — David Redding
(74) *Attorney, Agent, or Firm* — Schwegman Lundberg & Woessner, P.A.

(57) ABSTRACT

A mobile cleaning robot can include a body and a cleaning assembly. The body can include a suction duct. The cleaning assembly can be operable to ingest debris from a surface of an environment. The cleaning assembly can include a dustpan engageable with the surface to direct debris toward the suction duct. The dust pan can be movable with respect to the body.

19 Claims, 13 Drawing Sheets

MOBILE CLEANING ROBOT DUSTPAN

BACKGROUND

Autonomous mobile robots include autonomous mobile cleaning robots that can autonomously perform cleaning tasks within an environment, such as a home. An autonomous cleaning robot can navigate across a floor surface and avoid obstacles while vacuuming the floor surface and operating rotatable members carried by the robot to ingest debris from the floor surface. As the robot moves across the floor surface, the robot can rotate the rotatable members, which can engage the debris and guide the debris toward a vacuum airflow generated by the robot. The rotatable members and the vacuum airflow can thereby cooperate to allow the robot to ingest debris.

SUMMARY

Autonomous mobile cleaning robots can be useful to automatically or autonomously clean a portion, such as a room or rooms, of an environment by extracting debris off a surface of the room or rooms. Extraction can be performed using a pair of rollers that can rotate in opposite directions, which can help to improve debris extraction and cleaning performance. The use of a single roller can allow for a roller design that can help to reduce an amount of energy required during cleaning operations; however, with only a single rotating member, debris extraction can be more difficult.

This disclosure describes devices and methods that can help to address this problem such as by including a retracting dustpan. The dustpan can be engageable with the floor surface of the environment and with the roller to direct debris from the environment to a suction duct of the mobile cleaning robot, helping to provide effective debris extraction with a single roller. Because the dustpan, being engaged with the floor surface, may cause mobility issues during navigation of the mobile cleaning robot through the environment, the dustpan can be retractable to help improve robot mobility throughout an environment.

For example, a mobile cleaning robot can include a body and a cleaning assembly. The body can include a suction duct. The cleaning assembly can be operable to ingest debris from a surface of an environment. The cleaning assembly can include a dustpan engageable with the surface to direct debris toward the suction duct. The dust pan can be movable with respect to the body.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Autonomous mobile cleaning robots can be useful to automatically or autonomously clean a portion, such as a room or rooms, of an environment by extracting debris off a surface of the room or rooms. Extraction can be performed using a pair of rollers that can rotate in opposite directions, which can help to improve debris extraction and cleaning performance. The use of a single roller can allow for a roller design that can help to reduce an amount of energy required during cleaning operations; however, with only a single rotating member, debris extraction can be more difficult.

This disclosure describes devices and methods that can help to address this problem such as by including a retracting dustpan. The dustpan can be engageable with the floor surface of the environment and with the roller to direct debris from the environment to a suction duct of the mobile cleaning robot, helping to provide effective debris extraction with a single roller. Because the dustpan, being engaged with the floor surface, may cause mobility issues during navigation of the mobile cleaning robot through the environment, the dustpan can be retractable to help improve robot mobility throughout an environment.

The above discussion is intended to provide an overview of subject matter of the present patent application. It is not intended to provide an exclusive or exhaustive explanation of the invention. The description below is included to provide further information about the present patent application.

Figure 1A:
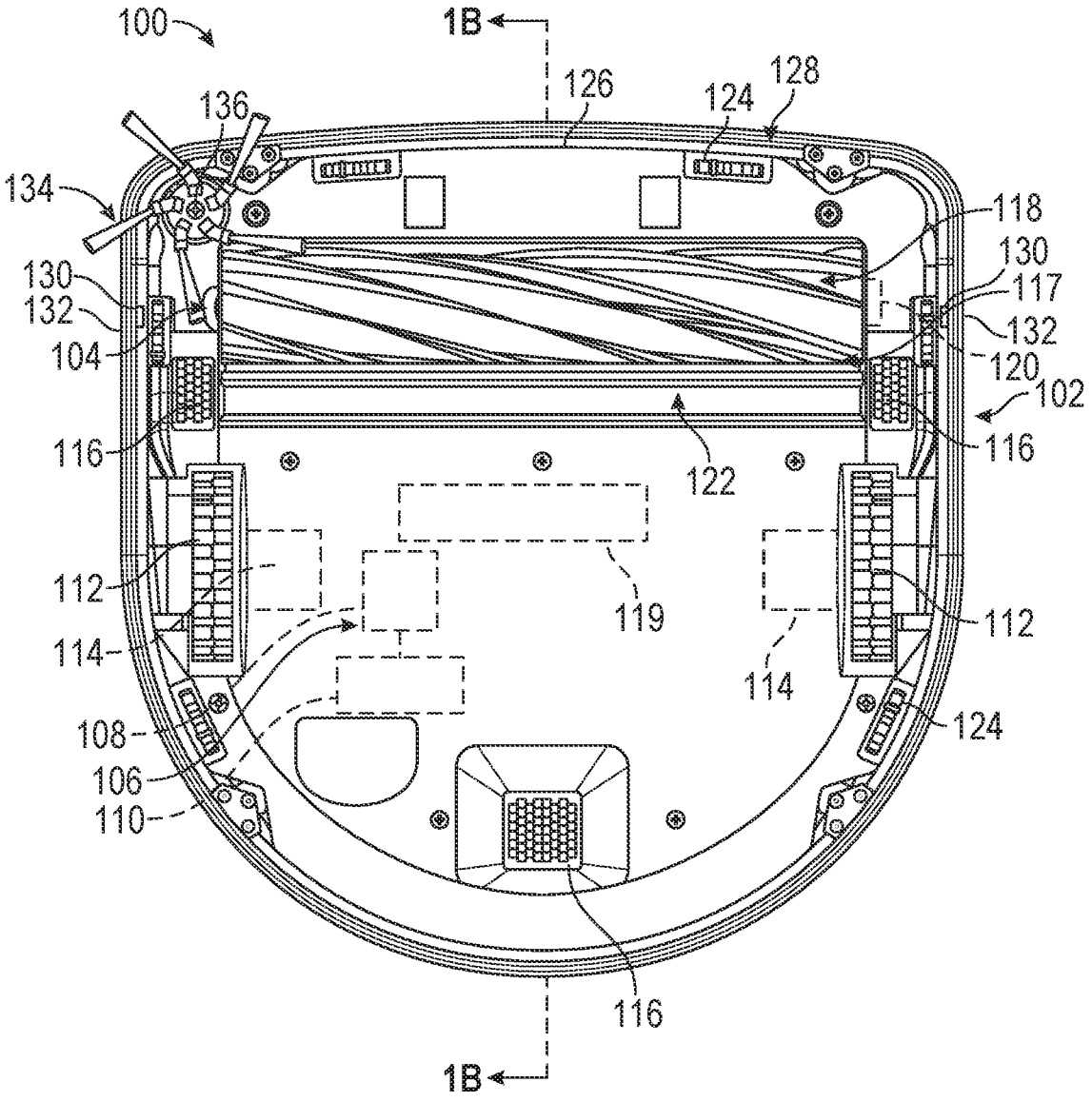
FIG. 1A illustrates a bottom view of a mobile cleaning robot.
Figure 1B:
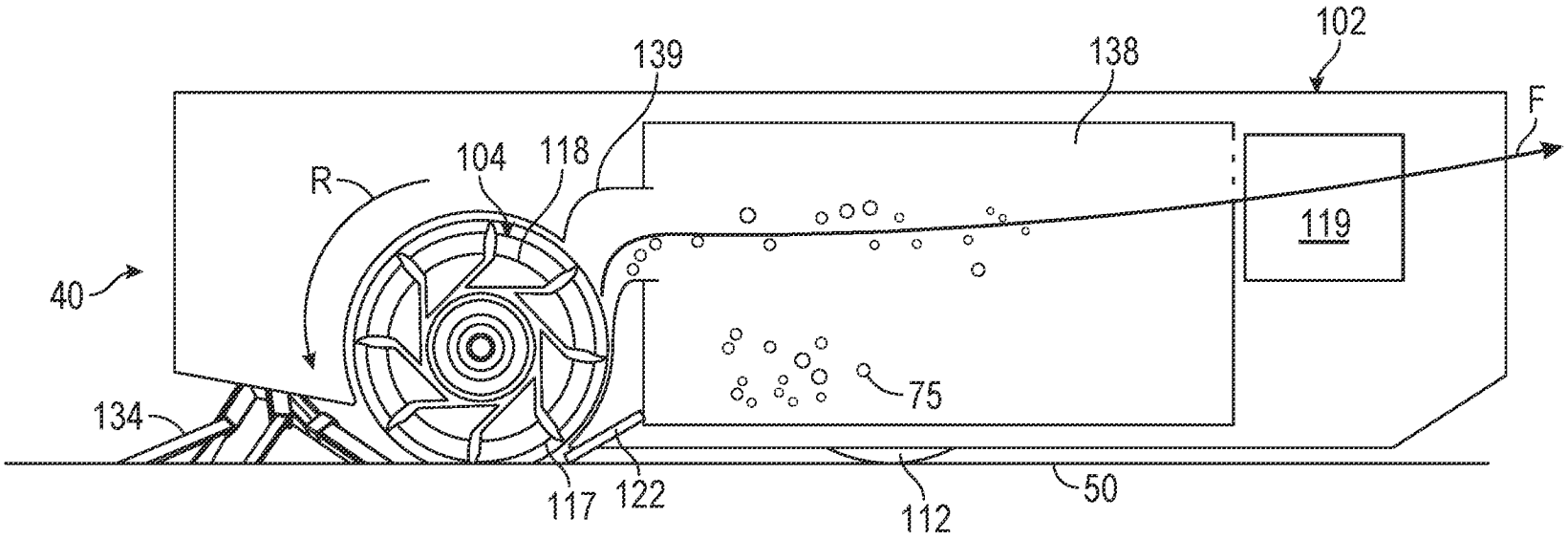
FIG. 1B illustrates a cross-sectional view of a mobile cleaning robot.

FIG. 1A illustrates a bottom view of a mobile cleaning robot 100. FIG. 1B illustrates a cross-sectional view of the mobile cleaning robot 100 in an environment 40. FIGS. 1A and 1B are discussed together below. FIG. 1A shows section indicators 1B-1B and FIG. 1B also shows directional arrows F and R.

The cleaning robot 100 can include a housing or body 102, a cleaning assembly 104, a control system 106 (which can include a controller 108 and memory 110). The cleaning robot 100 can also include drive wheels 112, motor(s) 114, and a support skid or skids 116. The cleaning assembly 104 can include a cleaning inlet 117 a roller 118 (or cleaning wheel), a vacuum system 119, a roller motor 120, and a dustpan 122 (or guide). The robot 100 can also include cliff sensors 124, proximity sensors 126, a bumper 128, bump sensors 130, an obstacle following sensor 132, and a brush 134 (or the side brush 134) including a motor 136.

The housing 102 can be a rigid or semi-rigid structure comprised of materials such as one or more of metals, plastics, foams, elastomers, ceramics, composites, combinations thereof, or the like. The housing 102 can be configured to support various components of the robot 100, such as the wheels 112, the controller 108, the cleaning assembly 104, the dustpan 122, and the side brush 134. The housing 102 can define the structural periphery of the robot 100. In some examples, the housing 102 includes a chassis, cover, bottom plate, and bumper assembly. Because the robot 100 can be a household robot, the robot 100 can have a small profile so that the robot 100 can fit under furniture within a home.

The roller 118 of the cleaning assembly 104 can be rotatably connected to the housing 102 near the cleaning inlet 117 (optionally located in a forward portion of the robot 100), where the roller 118 can extend horizontally across the robot 100. The roller 118 can be connected to the roller motor 120 to be driven to rotate the roller 118 relative to the housing 102 to help collect dirt and debris from the environment 40 through the cleaning inlet 117. The vacuum system 119 can include a fan or impeller and a motor operable by the controller 108 to control the fan to generate airflow through the cleaning inlet 117 between the roller 118 and into a debris bin 138 (shown in FIG. 1B).

The roller 118 can be of several types, such as when the roller 118 is optimized based on the environment 40, as discussed further below. The roller 118 can include bristles or brushes, which can be effective at separating (or agitating) debris within carpet fibers for suction by the robot 100. The roller 118 can also include vanes, fletches, or flexible members extending therefrom, which can be relatively effective at separating debris within carpet fibers for suction by the robot 100 while also being effective at pulling debris off hard surfaces. The roller 118 can also include no fins, vanes, or bristles, which can be effective at pulling debris off hard surfaces. The roller 118 can be other types of roller in other examples.

The controller 108 can be located within the housing and can be a programmable controller, such as a single or multi-board computer, a direct digital controller (DDC), a programmable logic controller (PLC), or the like. In other examples the controller 108 can be any computing device, such as a handheld computer, for example, a smart phone, a tablet, a laptop, a desktop computer, or any other computing device including a processor, memory, and communication capabilities. The memory 110 cam be one or more types of memory, such as volatile or non-volatile memory, read-only memory (ROM), random-access memory (RAM), magnetic disk storage media, optical storage media, flash-memory devices, and other storage devices and media. The memory 110 can be located within the housing 102, connected to the controller 108 and accessible by the controller 108.

The control system 106 can further include a sensor system with one or more electrical sensors, for example. The sensor system, as described herein, can generate a signal indicative of a current location of the robot 100, and can generate signals indicative of locations of the robot 100 as the robot 100 travels along the floor surface 50. The controller 108 can also be configured to execute instructions to perform one or more operations as described herein.

The drive wheels 112 can be supported by the body 102 of the robot 100, can be partially within the housing 102, and can extend through the bottom portion of the housing 102. The wheels 112 can also be connected to and rotatable with a shaft; the wheels 112 can be configured to be driven by the motors 114 to propel the robot 100 along the surface 50 of the environment 40, where the motors 114 can in communication with the controller 108 to control such movement of the robot 100 in the environment 40.

The skids 116 can be low friction elements connected to the body 102 of the robot and can be a passive body configured to help balance the robot 100 within the environment 40. Together, the drive wheels 112 and the skid(s) 116 can cooperate to support the housing 102 above the floor surface 50. For example, one skid 116 can be located in a rearward portion of the housing 102, and the drive wheels 112 can be located forward of the skid 116.

The dustpan 122 can be connected to the body 102 and can be engageable with the floor surface 50 (as shown in FIG. 1B) to help direct debris 5 from the environment 40 to the suction duct 139 for collection in the collection bin 138. The roller 118 can also be engageable with the dustpan 122 to direct debris 75 to the suction duct 139. As discussed in further detail below, the dustpan 122 can be actively or passively retractable to help improve mobility of the robot 100.

The cliff sensors 124 can be located along a bottom portion of the housing 102. Each of the cliff sensors 124 can be an optical sensor that can be configured to detect a presence or absence of an object below the optical sensor, such as the floor surface 50. The cliff sensors 124 can be connected to the controller 108. The proximity sensor(s) 126 can be located near a forward portion of the housing 102. In other examples, the proximity sensors 126 can be located on other portions of the housing 102. The proximity sensor 126 can include an optical sensor facing outward from the housing 102 and can be configured produce a signal based on a presence or the absence of an object in front of the optical sensor. The proximity sensor 126 can be connected to the controller.

The bumper 128 can be removably secured to the housing 102 and can be movable relative to housing 102 while mounted thereto. In some examples, the bumper 128 can form part of the housing 102. The bump sensors 130 can be connected to the housing 102 and engageable or configured to interact with the bumper 128. The bump sensors 130 can include break beam sensors, capacitive sensors, switches, or other sensors that can detect contact between the robot 100, i.e., the bumper 128, and objects in the environment 40. The bump sensors 130 can be connected to the controller 108.

The robot can optionally include an image capture device that can be a camera connected to the housing 102. The image capture device can be configured to generate a signal based on imagery of the environment 40 of the robot 100 as the robot 100 moves about the floor surface 50.

The obstacle following sensors 132 can include an optical sensor facing outward from the side surface of the housing 102 and that can be configured to detect the presence or the absence of an object adjacent to the side surface of the housing 102. The obstacle following sensor 132 can emit an optical beam horizontally in a direction perpendicular to the forward drive direction F of the robot 100. In some examples, at least some of the proximity sensor 126 and the obstacle following sensor 132 can include an optical emitter and an optical detector. The optical emitter can emit an optical beam outward from the robot 100, e.g., outward in a horizontal direction, and the optical detector detects a reflection of the optical beam that reflects off an object near the robot 100. The robot 100, e.g., using the controller 108, can determine a reflected intensity (or optionally a time of flight of the optical beam) and can thereby determine a distance between the optical detector and the object, and hence a distance between the robot 100 and the object.

The brush 134 can be connected to an underside of the robot 100 and can be connected to the motor 136 operable to rotate the side brush 134 with respect to the housing 102 of the robot 100. The side brush 134 can be configured to engage debris to move the debris toward the cleaning assembly 104 or away from edges of the environment 40. The motor 136 configured to drive the side brush 134 can be in communication with the controller 108.

In operation of some examples, the robot 100 can be propelled in a forward drive direction or a rearward drive direction. The robot 100 can also be propelled such that the robot 100 turns in place or turns while moving in the forward drive direction or the rearward drive direction.

The controller 108 can execute software stored on the memory 110 to cause the robot 100 to perform various navigational and cleaning behaviors by operating the various motors of the robot 100. For example, when the controller 108 causes the robot 100 to perform a mission, the controller 108 can operate the motors 114 to drive the drive wheels 112 and propel the robot 100 along the floor surface 50. In addition, the controller 108 can operate the motor 120 to cause the roller 118 to rotate, can operate the motor 136 to cause the brush 134 to rotate, and can operate the motor of the vacuum system 119 to generate airflow.

The roller 118 can be rotatable about an axis (shown in FIG. 1B) to contact the floor surface 50 to agitate debris 75 on the floor surface 50 as the rotatable member 118 rotate relative to the housing 102. The rotatable member 118 agitates debris 75 on the floor surface to direct the debris 75 from the cleaning inlet 117, toward a suction duct 139 (shown in FIG. 1B), and into the debris bin 138 within the robot 100. The vacuum system 119 can cooperate with the cleaning assembly 104 to draw debris 75 from the floor surface 50 into the debris bin 138. In some cases, airflow generated by the vacuum system 119 can create sufficient force to draw debris 75 on the floor surface 50 upward through the suction duct 139 and into the debris bin 138. The brush 134 can be rotatable about the non-horizontal axis in a manner that brushes debris on the floor surface 50 into a cleaning path of the cleaning assembly 104 as the robot 100 moves.

The various sensors of the robot 100 can be used to help the robot navigate and clean within the environment 40. For example, the cliff sensors 124 can detect obstacles such as drop-offs and cliffs below portions of the robot 100 where the cliff sensors 124 are disposed. The cliff sensors 124 can transmit signals to the controller 108 so that the controller 108 can redirect the robot 100 based on signals from the cliff sensors 124. The proximity sensors 126 can produce a signal based on a presence or the absence of an object in front of the optical sensor. For example, detectable objects include obstacles such as furniture, walls, persons, and other objects in the environment 40 of the robot 100. The proximity sensor 126 can transmit signals to the controller 108 so that the controller 108 can redirect the robot 100 based on signals from the proximity sensors 126.

In some examples, the bump sensor 130 can be used to detect movement of the bumper 128 of the robot 100. The bump sensors 130 can transmit signals to the controller 108 so that the controller 108 can redirect the robot 100 based on signals from the bump sensors 130. In some examples, the obstacle following sensors 132 can detect detectable objects, including obstacles such as furniture, walls, persons, and other objects in the environment of the robot 100. In some implementations, the sensor system can include an obstacle following sensor along the side surface, and the obstacle following sensor can detect the presence or the absence an object adjacent to the side surface. The one or more obstacle following sensors 132 can also serve as obstacle detection sensors, similar to the proximity sensors described herein.

The robot 100 can also include sensors for tracking a distance travelled by the robot 100. For example, the sensor system can include encoders associated with the motors 114 for the drive wheels 112, and the encoders can track a distance that the robot 100 has travelled. In some implementations, the sensor can include an optical sensor facing downward toward a floor surface. The optical sensor can be positioned to direct light through a bottom surface of the robot 100 toward the floor surface 50. The optical sensor can detect reflections of the light and can detect a distance travelled by the robot 100 based on changes in floor features as the robot 100 travels along the floor surface 50.

The controller 108 can use data collected by the sensors of the sensor system to control navigational behaviors of the robot 100 during the mission. For example, the controller 108 can use the sensor data collected by obstacle detection sensors of the robot 100, (the cliff sensors 124, the proximity sensors 126, and the bump sensors 130) to enable the robot 100 to avoid obstacles within the environment of the robot 100 during the mission.

The sensor data can also be used by the controller 108 for simultaneous localization and mapping (SLAM) techniques in which the controller 108 extracts features of the environment represented by the sensor data and constructs a map of the floor surface 50 of the environment. The sensor data collected by the image capture device can be used for techniques such as vision-based SLAM (VSLAM) in which the controller 108 extracts visual features corresponding to objects in the environment 40 and constructs the map using these visual features. As the controller 108 directs the robot 100 about the floor surface 50 during the mission, the controller 108 can use SLAM techniques to determine a location of the robot 100 within the map by detecting features represented in collected sensor data and comparing the features to previously stored features. The map formed from the sensor data can indicate locations of traversable and nontraversable space within the environment. For example, locations of obstacles can be indicated on the map as nontraversable space, and locations of open floor space can be indicated on the map as traversable space.

The sensor data collected by any of the sensors can be stored in the memory 110. In addition, other data generated for the SLAM techniques, including mapping data forming the map, can be stored in the memory 110. These data produced during the mission can include persistent data that are produced during the mission and that are usable during further missions. In addition to storing the software for causing the robot 100 to perform its behaviors, the memory 110 can store data resulting from processing of the sensor data for access by the controller 108. For example, the map can be a map that is usable and updateable by the controller 108 of the robot 100 from one mission to another mission to navigate the robot 100 about the floor surface 50.

Figure 2A:
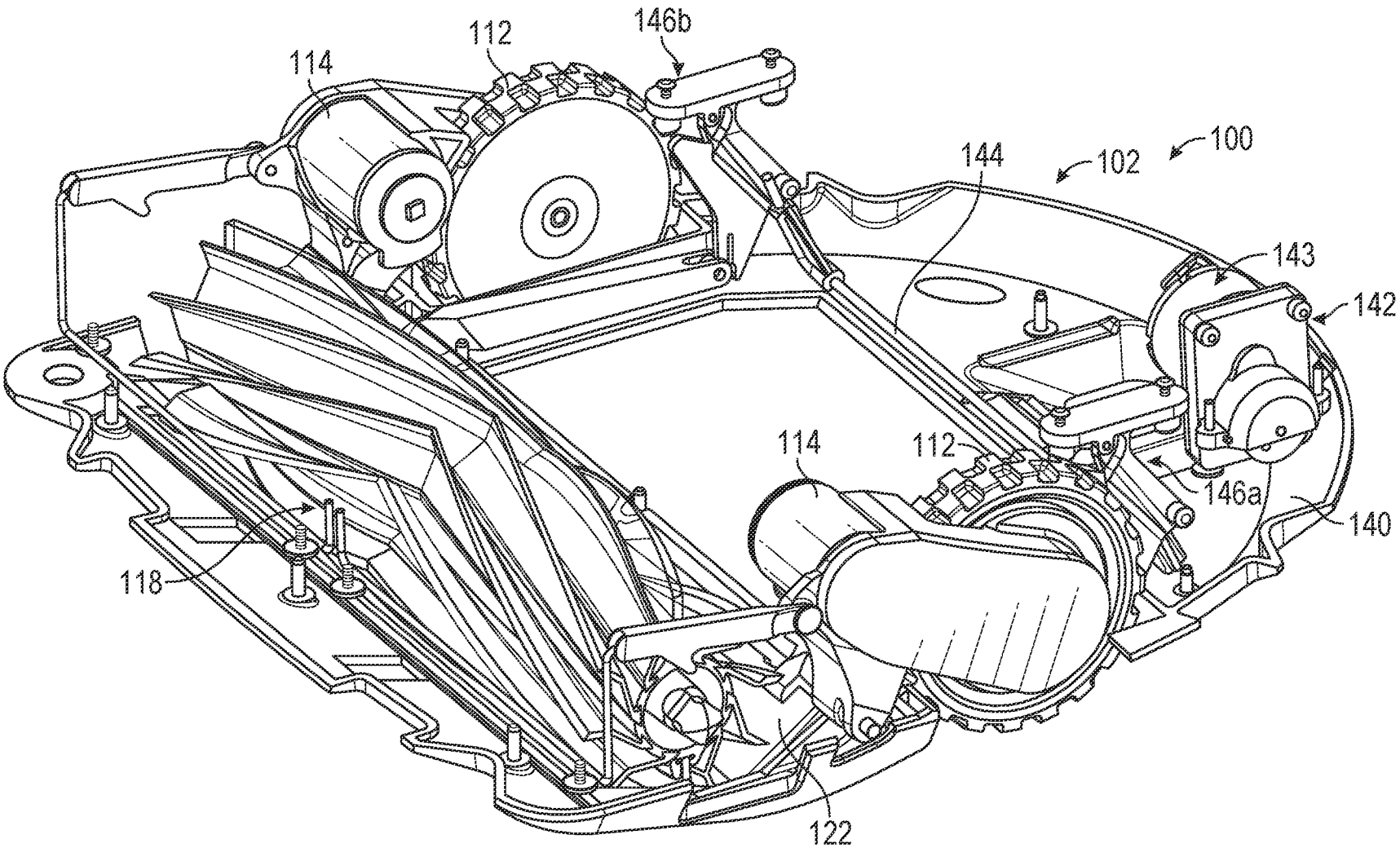
FIG. 2A illustrates a top isometric view of a portion of a mobile cleaning robot.
Figure 2B:
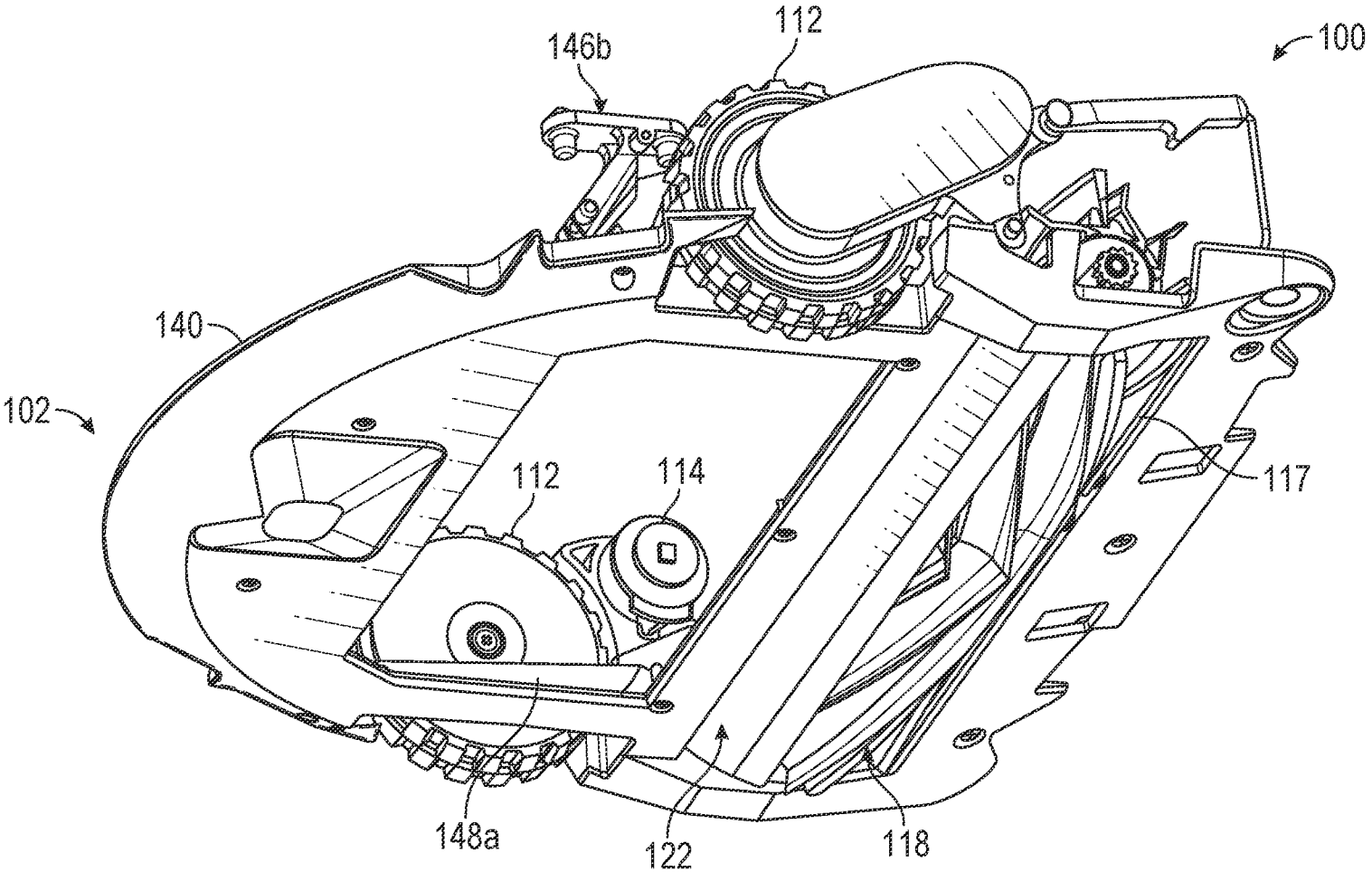
FIG. 2B illustrates a bottom isometric view of a portion of a mobile cleaning robot.
Figure 2C:
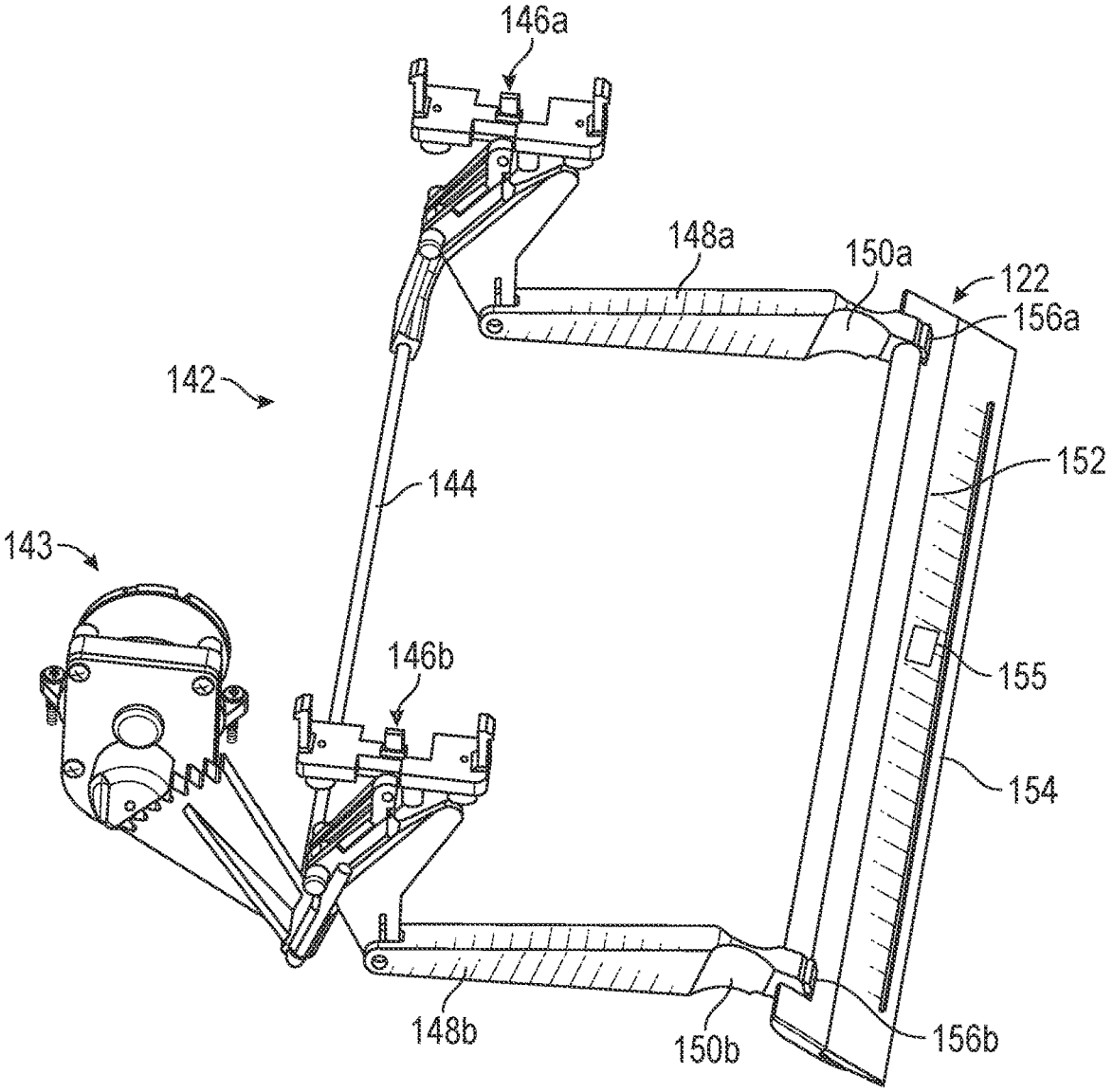
FIG. 2C illustrates a top isometric view of a portion of a mobile cleaning robot.

FIG. 2A illustrates a top isometric view of a portion of the mobile cleaning robot 100. FIG. 2B illustrates a bottom isometric view of a portion of the mobile cleaning robot 100. FIG. 2C illustrates a top isometric view of a portion of the mobile cleaning robot 100. FIGS. 2A-2C are discussed together below. The mobile cleaning robot 100 of FIGS. 2A-2C can be consistent with the mobile cleaning robot 100 of FIGS. 1A and 1B; additional details of the mobile cleaning robot 100 are discussed with respect to FIGS. 2A-2C. For example, FIG. 2A shows further details of the dustpan 122, such as a sled, skid plate, or bottom portion 140 of the body or housing 102, which can include the skids 116 and can generally form a protective undercarriage for the body 102 and the robot 100. The sled 140 can also define the cleaning inlet 117.

FIGS. 2A and 2B also show that the dustpan 122 can be connected to a drive assembly 142 (shown in FIG. 2A), which can be in communication with the controller 108. The drive assembly 142 can include a motor (e.g., AC or DC) 143 connected to a cross-shaft 144. The motor 143 can be a solenoid or quick-acting motor in some examples. The drive assembly 142 can be an (optional) active retraction system for the dustpan 122 such that the motor 143 can pull the dustpan 122 into the retracted position for a brief period (e.g., a fraction of a second). Such retraction of the dustpan 122 can also help to avoid ingestion of obstacles (e.g., a cord or rug tassel), helping to avoid incomplete missions. The cross-shaft 144 can be connected to spring modules 146*a* and 146*b*.

The spring modules 146*a* and 146*b* can be connected to the housing 102 and to the dustpan 122 via arms 148*a* and 148*b* (collectively referred to as arms 148), respectively, of the dustpan 122. The spring modules 146*a* and 146*b* can form a passive retraction system for the dustpan 122, which can apply a force (or forces) on the arms 148*a* and 148*b*, respectively, to bias the dustpan 122 away from the spring modules 146 and toward the roller 118. The spring modules 146 can apply a constant force onto the arms 148 and the dustpan 122. The spring modules 146 can thereby allow the arms 148*a* and 148*b* and the dustpan 122 to move away from the roller 118, such as in response to engagement with a rug or other threshold, to help improve mobility and reduce damage to the dustpan 122 during navigation of the robot 100 through the environment. Following movement away from the roller 118, the spring modules 146 can return the arms 148 and dustpan 122 to its extended and operating position, as shown in FIG. 2B. By biasing the dustpan forward, the spring modules 146 can help ensure the dustpan 122 remains engaged with the flooring surface, helping to improve cleaning efficiency. Also, the spring modules 146 can help ensure the dustpan 122 engages the floor surface even as the leading edge of the dustpan 122 wears down over time.

Figure 4A:
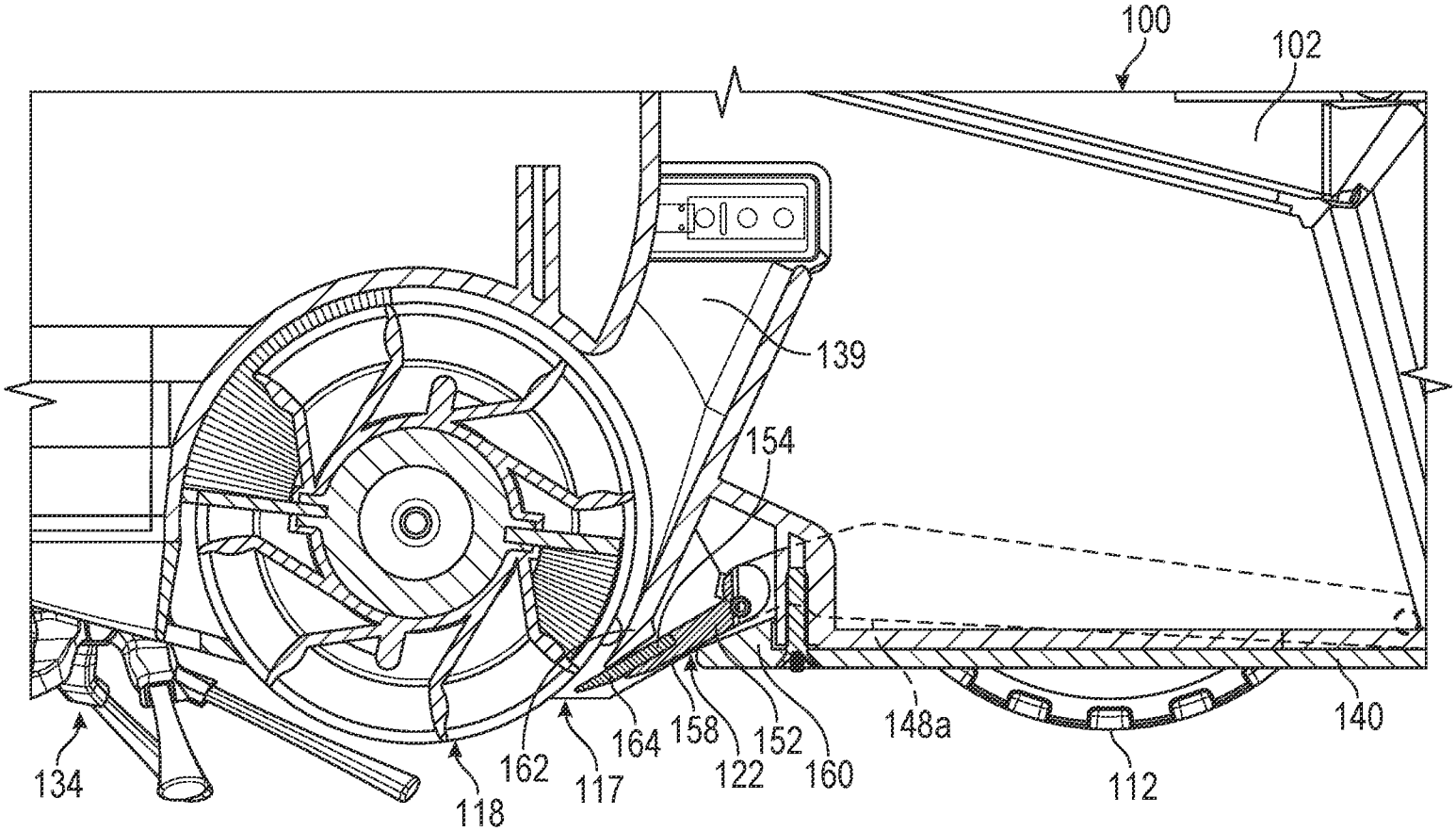
FIG. 4A illustrates a side cross-sectional view of a portion of a mobile cleaning robot.

The motor 143, which can be optionally included, can be operated, such as by the controller 108 to move the dustpan 122 between an extended position (shown in FIGS. 4B and 4C) and a retracted position (shown in FIG. 4A). The dustpan 122 can be engageable with the surface 50 to direct debris toward the suction duct 139 when the dustpan 122 is in the extended position. In the retracted position, the dustpan 122 is not in a position to contact the surface 50 or other obstacles in the environment 40, helping to improve mobility of the robot 100. The cross-shaft 144 can allow the motor 143 to move both of the arms 148*a* and 148*b* at the same time or together to operate the dustpan 122 symmetrically (or substantially symmetrically) with respect to the body 102 and the roller 118.

FIG. 2C also shows that the arms 148*a* and 148*b* can include flexures 150*a* and 150*b* (collectively referred to as flexures 150), respectively. The flexures 150 can be compliant hinges located near the dustpan 122 that can be configured to allow the arms 148*a* and 148*b* to flex with respect to each other to allow the dustpan 122 to move asymmetrically with respect to the body 102 or the roller 118, which can help navigate the dustpan 122 over uneven surfaces such as floor tiles. To help enable such movement, the flexures 150*a* and 150*b* can have a reduced thickness from other portions of the arms 148. To further enable such movement, the arms 148*a* and 148*b* can be made of a relatively flexible material, such as a polymer or spring steel. Also, optionally, an axis of the flexures 150 can be normal or perpendicular to a plane of the dustpan 122 to help allow the dustpan 122 to comply with a slot (e.g., slot 158 discussed below with respect to FIGS. 4A-4C), which can help allow the dustpan 122 to avoid wedging within the slot.

FIG. 2C also shows that the dustpan 122 can include a rigid portion 152 and a flexible portion 154. The flexible portion 154 can define a leading edge of the dustpan 122 that can be engageable with the surface. The flexible portion 154 or blade can extend from the rigid portion 152 and can be made of a resilient material, such as a plastic, rubber, polyvinyl chloride (PVC), a combination thereof, or the like, such that the flexible portion 154 can be a compliant or flexible portion that is configured to flex or move with respect to the rigid portion 152, the body 102, or the roller 118. Such flexibility can help to form a seal between the dustpan 122 and the floor surface 50 during cleaning operations. Such flexibility can also allow the dustpan 122 to flex around protrusions in the floor surface 50 or inconsistent portions of the floor surface 50 (e.g., tiles or nail heads). The flexible portion 154 can optionally include a wear indicator, such as an indicator including a different color, shape, or size, that can serve as a visual indicator that replacement of the dustpan 122 is needed. The wear indicator can optionally be a sensor embedded in the dustpan 122.

The dustpan 122 can also include bumpers 156*a* and 156*b*, which can extend from ends of the arms 148 and 148*b*, respectively. The bumpers or dampers 156 can be configured to engage a portion of the body 102 to limit translation of the arms 148 and the dustpan with respect to the body 102 and the roller 118, as discussed in further detail below. Such engagement between the bumpers 156 and the body 102, can help to reduce noise during operation of the dustpan 122.

FIG. 2C also shows that the dustpan 122 can include a sensor 155 connected thereto. For example, the sensor 155 can be connected to the rigid portion 152. The sensor 155 can be a proximity sensor, such as an optical sensor, or a Hall effect sensor. Optionally, the sensor 155 can sense an adjacent portion of the body 102 of the robot 100. The sensor 155 can be configured to produce a signal based on a proximity of the sensor 155 (and therefore the dustpan 122) to the body 102 or another object. The sensor 155 can be in communication with the controller 108 to transmit the signal thereto.

Optionally, the controller 108 can be configured to analyze the signal to determine a position or location of the dustpan 122 with respect to the body 102, such as to determine if the dustpan 122 becomes stuck in a retracted position or another position. Optionally, the controller 108 can use the signal from the sensor 155 to confirm a location of the dustpan. For example, when the controller 108 operates the drive system 142 to retract the dustpan 122, the signal can be used by the controller 108 to confirm that the dustpan 122 retracts and then returns. If the location of the dustpan 122 does not match the anticipated location, an error or alert can be produced and transmitted to, for example, the user.

Figure 3:
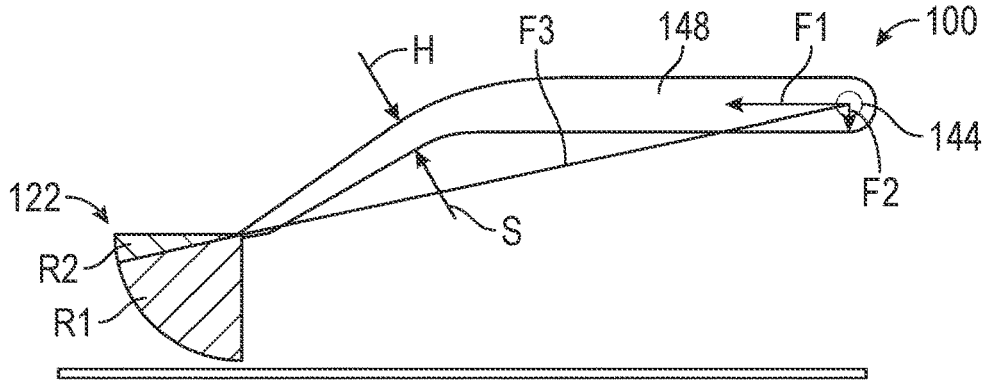
FIG. 3 illustrates a schematic view of a portion of a mobile cleaning robot.

FIG. 3 illustrates a schematic view of a portion of the mobile cleaning robot 100, specifically an arm 148 and the dustpan 122, along with forces H and S. FIG. 3 also shows ranges R1 and R2. The force S can be a force applied to the arm 148 by the skid plate to help limit downward movement of the arm 148 and the dustpan 122 with respect to the body 102 and the floor surface 50, such as when the robot 100 is not on the floor surface 50.

The spring module 146 can apply forces F1 and F2 on the arm 148 to transfer the resulting force F3 to the dustpan 122. The force F1 applied by both spring modules 146 (on the dustpan 122) can be between 0.5 and 10 Newtons (N). The force F1 can optionally be between 1 and 5 Newtons. The force F1 can optionally be about 3 Newtons. The resultant force F3 can create a pressure angle between the dustpan 122 and the floor surface.

Forces R1 and R2 are a total range of forces that can be applied to the dustpan 122. R1 shows a range of forces that can be applied to the dustpan 122, such as by the floor surface or other obstacles. When forces applied to the dustpan 122 are in the range R1, the dustpan 122 can be held in its desired position (in contact with the floor surface and the body 102 of the robot 100, and optionally the roller 118) and can create a seal with the housing 102 through the application of the resultant force H, which can be applied by a wall of the body 102.

When forces applied to the dustpan 122 are in the range R2, the force applied at R2 will be larger than the force F1 (in an opposing direction thereto), due to the downward load of the robot 100. Such a force can cause the dustpan 122 to attempt to turn or rotate under the body 102. The force S, which can be applied by the sled 140, can help to prevent the dustpan 122 from rotating under the sled 140 by the spring module 146 allowing the dustpan 122 and the arm 148 to move away from the force F1 (back into the body 102) temporarily until the object applying the force in the range R2 stops doing so. Once the force in the range R2 is removed, the spring module 146 will return the arm 148 and the dustpan 122 to its extended position.

When concentrated forces, such as forces creating a high pressure (e.g., a nail head) are applied to the dustpan 122 in the range R2, the flexible portion 154 can locally deflect to allow the obstacle applying the light force to pass under the dustpan 122, helping to limit unnecessary movement of the dustpan 122 with respect to the body 102 and the roller 118, helping to limit impact to the forward motion of the robot 100, and helping to improve cleaning efficiency.

Figure 4B:
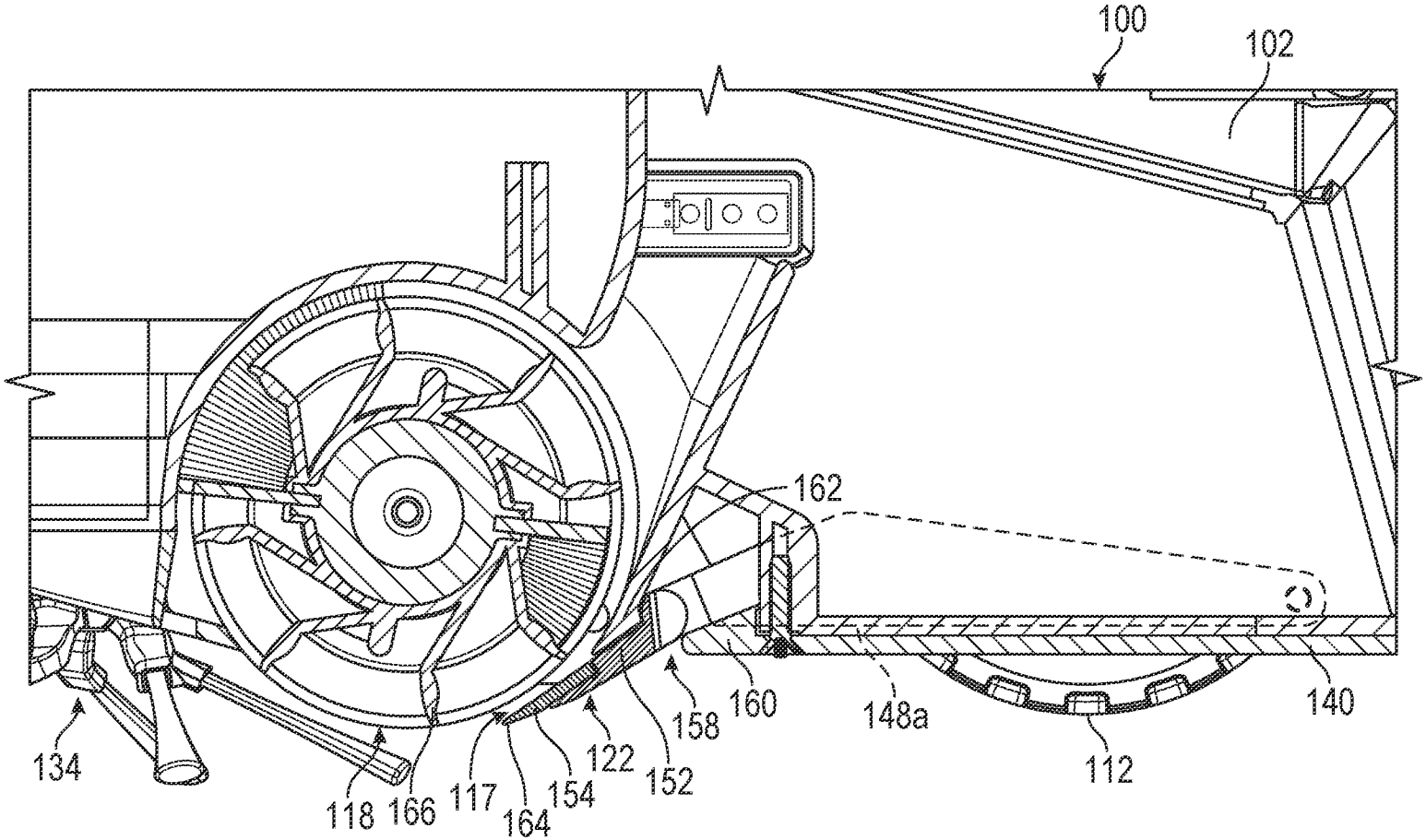
FIG. 4B illustrates a side cross-sectional view of a portion of a mobile cleaning robot.
Figure 4C:
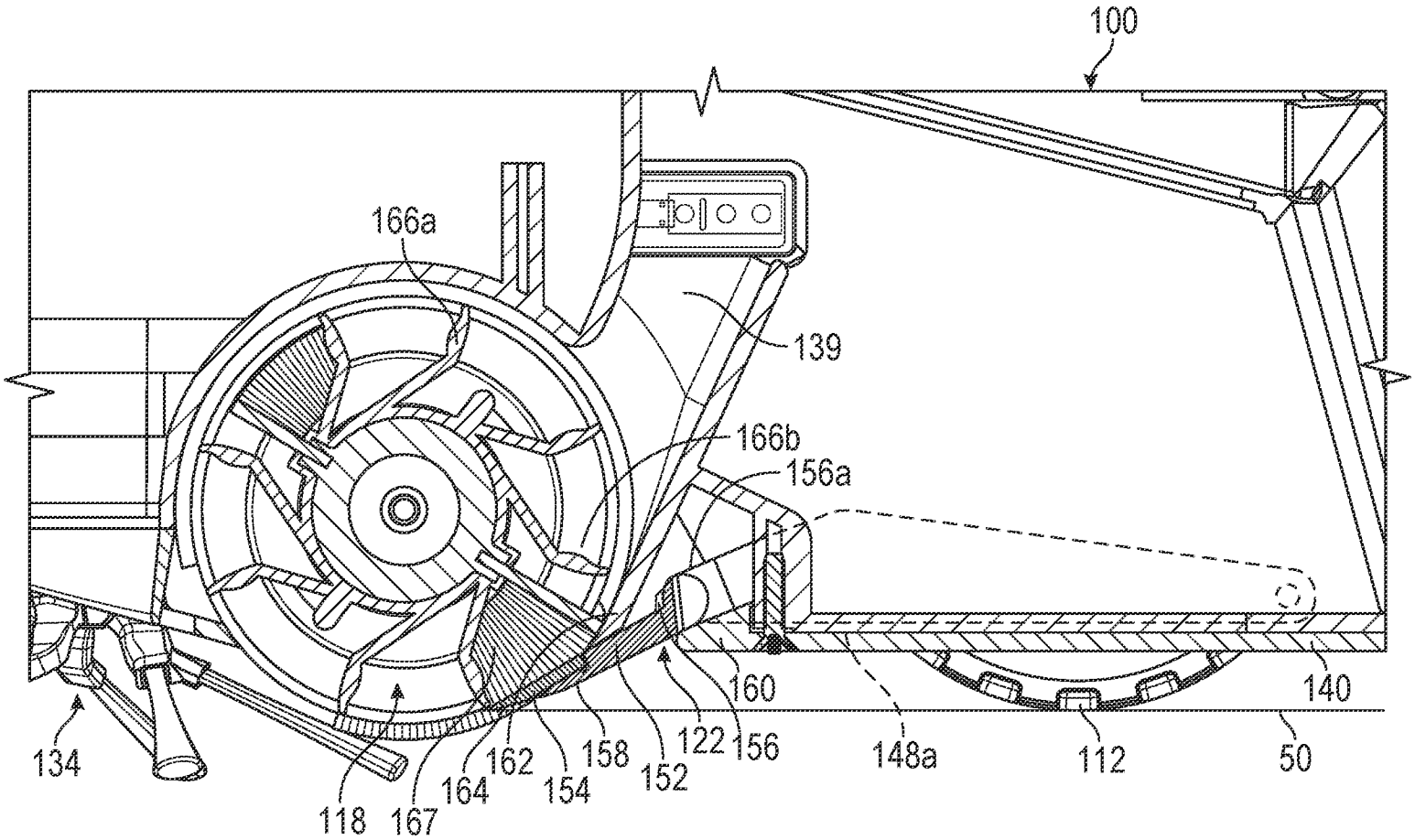
FIG. 4C illustrates a side cross-sectional view of a portion of a mobile cleaning robot.

FIG. 4A illustrates a side cross-sectional view of a portion of the mobile cleaning robot 100. FIG. 4B illustrates a side cross-sectional view of a portion of the mobile cleaning robot 100. FIG. 4C illustrates a side cross-sectional view of a portion of the mobile cleaning robot 100. FIGS. 4A-4C are discussed together below. The mobile cleaning robot 100 of FIGS. 4A-4C can be consistent with the mobile cleaning robot 100 of FIGS. 1A-3; additional details of the mobile cleaning robot 100 are discussed with respect to FIGS. 4A-4C. For example, FIG. 4A shows the dustpan 122 in a retracted or partially retracted position, FIG. 4B shows the dustpan 122 in an extended position, and FIG. 4C shows the dustpan 122 in a neutral position.

As shown in FIG. 4A, when the dustpan 122 is in the retracted position (mobility mode) or is not in the extended position (when the dustpan 122 is not engaged with the floor surface 50 or the roller 118), the roller 118 is free to rotate without contacting the dustpan 122. This can allow the roller 118 to act as an additional drive wheel to overcome obstacles (e.g., rug or threshold), which can help to improve mobility of the robot 100.

FIGS. 4A-4C also show how an internal portion of the body 102 of the robot can form, together with the sled 140, a slot 158 for the dustpan 122 to extend through. The slot 158 can be formed by a wall 162 and a projection 160 of the sled 140. The wall 162 can also define, in part, the suction duct 139. The slot 158 (i.e., the projection 160 and the wall 162) can guide extension of the dustpan 122 as it moves from the retracted position, to the partially retracted position of FIG. 4A, to the extended position of FIGS. 4B and 4C.

As shown in FIGS. 4B and 4C, when the motor 143 releases to allow the spring modules 146 to extend the dustpan 122, the dustpan 122 can engage the wall 162. (In other examples, the motor 143 can be reversed to partially or entirely extend the dustpan 122). This engagement can form a seal between the wall 162 (of the suction duct 139) and the dustpan 122 to help direct debris into the suction duct 139 and to help limit debris from entering the dustpan slot 158 and other areas within the body 102 of the mobile cleaning robot 100.

When the dustpan is in the neutral position, shown in FIG. 4C, the position of the cleaning mode, the dustpan 122, more specifically a tip 164 of the flexible portion 154 of the dustpan 122, can engage the floor surface 50 and can be configured to engage fletches 166 of the roller 118 as they rotate to pass the dustpan 122. In this position, the bumper 156 can be offset from the wall 162 to help to such that the dustpan is free to move forward (toward the floor surface 50) or backwards. This can allow the tip 164 to extend below the surface 50 of the floor, such as to account for wearing of the dustpan edge (e.g., tip 164), and to allow the tip 164 to extend into floor variations for effective cleaning. Optionally, the tip 164 can be configured to extend between 1 millimeter (mm) and 5 mm below the flooring surface 50. In some examples, the tip 164 can be configured to extend about 2 mm below the flooring surface 50.

As shown in FIG. 4C, a bristle portion 167 can engage the floor surface 50 and the dustpan 122 simultaneously or nearly simultaneously, to help to direct debris from the floor surface 50 into the suction duct 139 for extraction of the debris from the floor surface 50. Also, because the dustpan 122 is forced to engaged the floor surface 50, the dustpan 122 can act as an extension of the floor surface 50, which can help reduce noise caused by contact between the roller 118, the floor surface 50, and the dustpan 122.

When the dustpan 122 is in the fully extended position, shown in FIG. 4C, the bumpers (e.g., 156*a*) can engage the wall 162 when the dustpan 122 over-extends (such as due to a floor surface inconsistency, such as a grout line or end of a flooring transition) to help to limit extension of the dustpan 122 with respect to the wall 162 and therefore the body 102 and the roller 118. The bumpers 156 can thereby act as dampers to reduce an intensity of impact between the arms 148 and the wall 162, which can reduce noise during operation of the robot 100 and can help to increase component life. The bumpers 156 can be set back from the wall 162 in normal operation when the dustpan 122 is engaged with the floor 50, to help allow the dustpan 122 to move or float with the surface of the floor surface 50. Also, because the dampers 156 are set back from the wall 162, the dustpan 122 has room to extend further forward with respect to the roller 118, such as when the flexible portion 154 of the dustpan 122 wears down from use (e.g., gradually over time), helping to increase a life span of the dustpan 122.

The bristles 167 can also act as lifters to help improve mobility of the robot 100, such as for passing over obstacles such as thresholds. When the robot 100 encounters an obstacle within the roller area, the roller fletches 166 can conform around the obstacle and the obstacle can run into the back wall of the cleaning head. The bristles 167 can act as lifters on the 118 to help lift the robot 100 far enough above such obstacles to assure they can pass under the sled or skid-plate 140, helping to improve mobility of the robot 100.

Figure 5A:
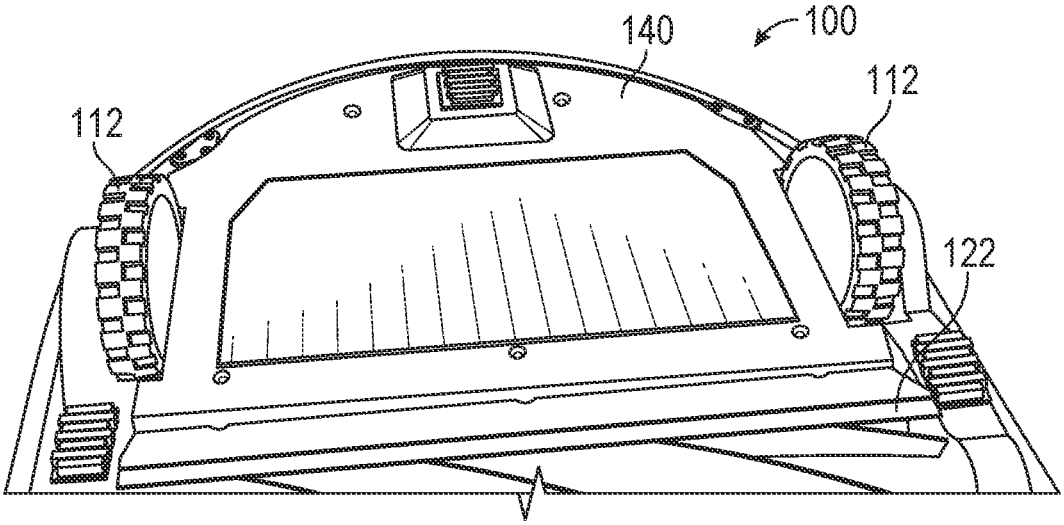
FIG. 5A illustrates a perspective of a portion of a mobile cleaning robot.
Figure 5B:
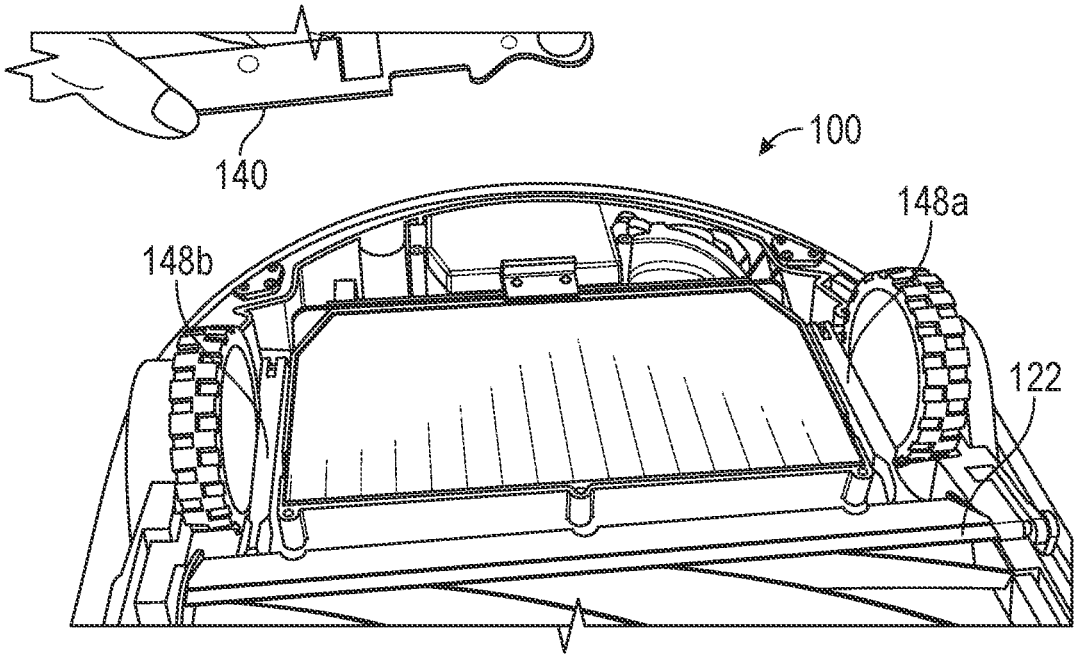
FIG. 5B illustrates a perspective of a portion of a mobile cleaning robot.
Figure 5C:
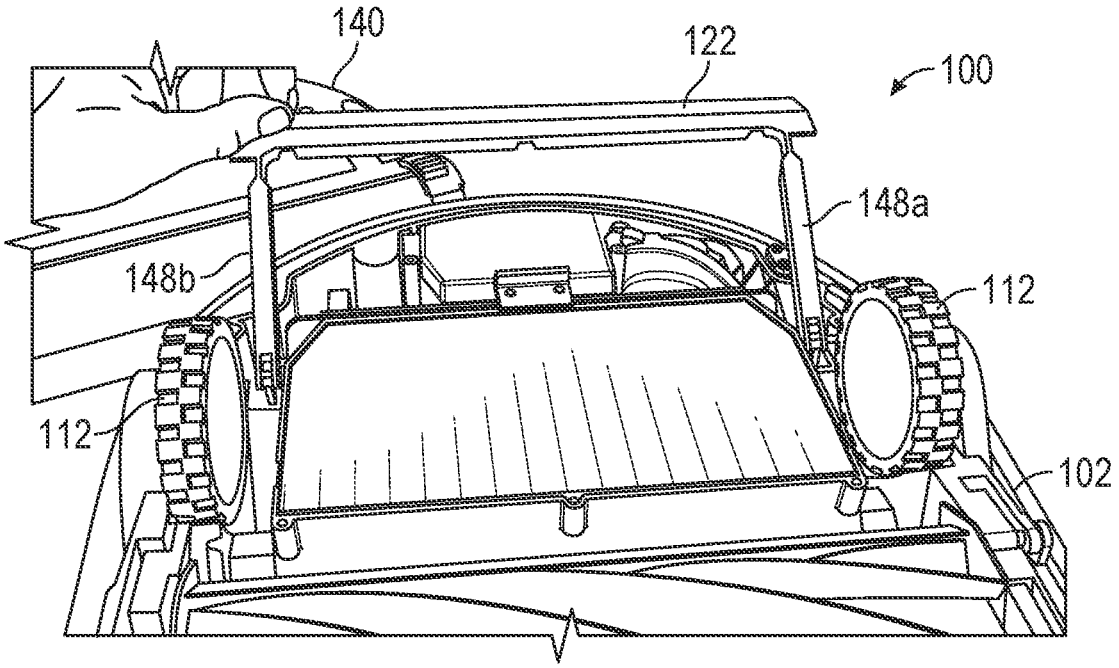
FIG. 5C illustrates a perspective of a portion of a mobile cleaning robot.

FIG. 5A illustrates a perspective of a portion of the mobile cleaning robot 100. FIG. 5B illustrates a perspective of a portion of the mobile cleaning robot 100. FIG. 5C illustrates a perspective of a portion of the mobile cleaning robot 100. FIGS. 5A-5C are discussed together below and show how the dustpan 122 can be removed from the body 102 of the mobile cleaning robot 100.

When it is desired to remove the dustpan 122 for replacement or cleaning (or other service of the robot 100), the sled 140 can be removed from the body 102, as shown in FIGS. 5A and 5B. With the sled 140 removed, the dustpan 122 is free to rotate about the spring modules 146 such that the dustpan 122 and arms 148 can be rotate with respect to the body 102, as shown in FIG. 5C. When the arms 148 and dustpan 122 are rotated to a position where the arms are perpendicular (or substantially perpendicularly, such as within 5 or 10 degrees of perpendicular), the arms 148 can be more easily disconnected from the spring modules 146 and the dustpan 122 and arms 148 can be removed from the body 102 for replacement or cleaning. The dustpan 122 can be disconnected from the arms 148 in any position of the dustpan 122; however, moving the dustpan 122 to a near perpendicular position allows for increased leverage, making disconnection easier. The arms 148 and dustpan 122 can be reattached to the spring modules 146 in a similar manner (arms 148 perpendicular to the body 102). Upon reinstallation of the dustpan 122, the spring modules 146 can force the dustpan to engage the wall 162, helping to constrain the dustpan 122 before the sled 140 is reinstalled, helping to improve ease of installation (or reinstallation).

Figure 6A:
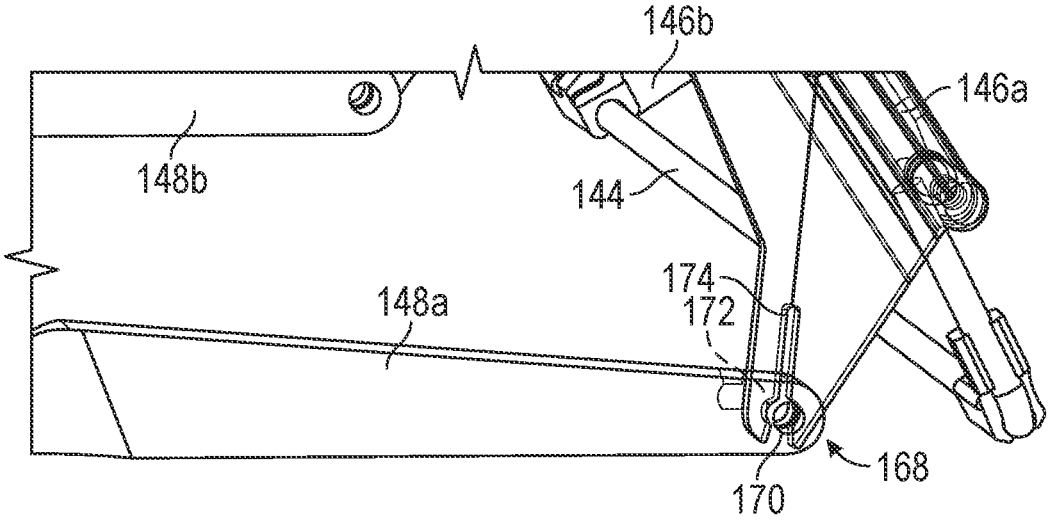
FIG. 6A illustrates an isometric view of a portion of a mobile cleaning robot.

FIG. 6A illustrates an isometric view of a portion of the mobile cleaning robot 100. FIG. 6A shows how the arms 148 connect to the spring module 146. The spring module 146*a* and the arm 148*a* can form a snap interface 168 for separation of the arms 148 from the spring modules 146. More specifically, the arm 148*a* can include a boss or pin 170 and the spring module can include a bore 172 and a slot 174. The bore 172 can be sized to receive and retain the boss 170 of the arm 148*a* therein. The slot 174 can allow the spring module to flex (e.g., elastically deform) to allow the boss or pin 170 to move in and out of the bore 172 in response to a force sufficient to open the bore 172 sufficiently wide. The snap interface 168 can thereby allow for quick and easy disconnection (and connection) of the arms 148 from (and to) the spring modules 146, respectively.

In another example, the spring modules 146 can include slots to receive the boss 170 (or pin) therein, where the boss 170 can include flats and the slot (e.g., the slot 174) can receive the boss 170 when the flats are oriented to allow the boss 170 to move through the open end of the slot and into the bore 172 where the boss 170 can be rotated (e.g., 90 degrees) such that the flats no longer align with the slot 174 and the pin or boss 170 cannot back out from the slot 174.

Figure 6B:
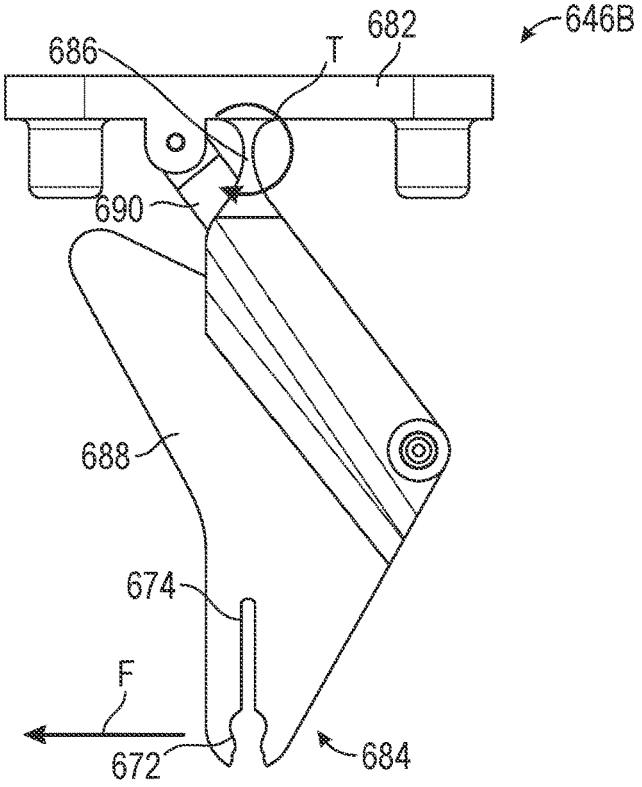
FIG. 6B illustrates a side view of a portion of a mobile cleaning robot.

FIG. 6B shows a side view of a spring module 646B. The spring module 646 can be similar to those discussed above; the spring module 646B can include a living hinge. Any of the spring modules discussed below or above can be modified to include a living hinge.

The spring module 646B can include a top portion 682, which can be a rigid or semi-rigid member configured to connect to a body (e.g., the body 102) of the robot. The spring module 646 can also include a bottom portion 684 that can include a bore 672 and slot 674 (that can be similar to the bore 172 and the slot 174), and that can connect to the cross-shaft 144 of the dustpan 122. The module 646 can also include a hinge 686 that can connect the top portion 682 to a body 688, which can be connected to or can include the bottom portion 684. The hinge 686 can be a living hinge configured to allow movement of the body 688 (and therefore the bottom portion 684) with respect to the top portion 682 and the body 102 of the robot. The body 688 can also be connected to the top portion 682 by an extension spring 690 (or biasing element), that can create a torque T to bias the body 688 and the bottom portion 684 in the direction of force F.

In operation, the drive assembly (e.g., the drive assembly 142) can overcome the biasing force F to retract the cross shaft 144 to retract the dustpan 122, where the cross-shaft 144 can allow spring modules on both sides to be retracted at the same time. The dustpan 122 can also encounter obstacles in the environment that can overcome the force F to allow the dustpan 122 to move rearward during operation.

Figure 6C:
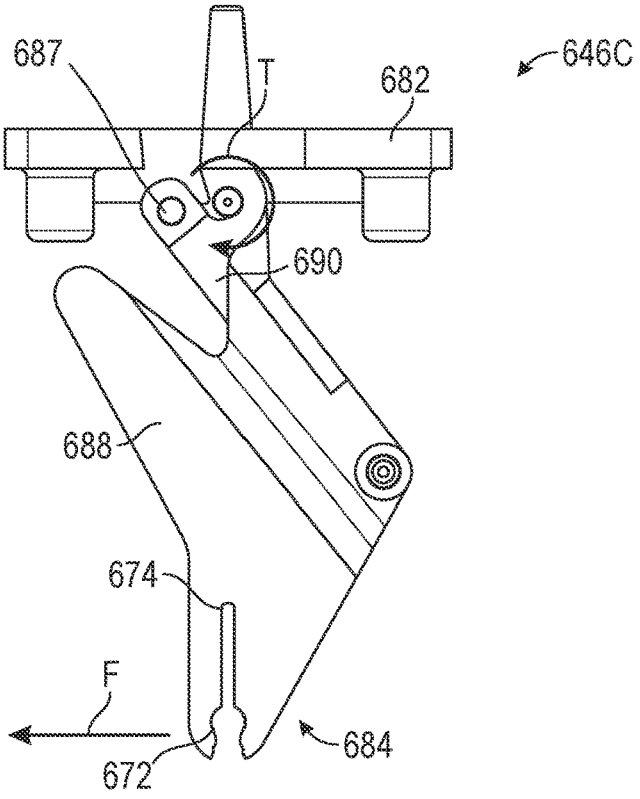
FIG. 6C illustrates a side view of a portion of a mobile cleaning robot.

FIG. 6C shows a side view of a spring module 646C. The spring module 646C can be similar to those discussed above; the spring module 646C can include a joint and a spring. Any of the spring modules discussed below or above can be modified to include a joint and a spring.

The spring module 646 can include a top portion 682, which can be a rigid or semi-rigid member configured to connect to a body (e.g., the body 102) of the robot. The spring module 646 can also include a bottom portion 684 that can include a bore 672 and slot 674 (that can be similar to the bore 172 and the slot 174), and that can connect to the cross-shaft 144 of the dustpan 122. The module 646 can also include a joint 687 that can connect the top portion 682 to the bottom portion 684. The joint 687 can be a pivoting or rotating joint such as to allow the bottom portion 684 to rotate with respect to the top portion 682. The body 688 can also be connected to the top portion 682 by an extension spring 690 (or biasing element), that can create a torque T to bias the body 688 and the bottom portion 684 in the direction of force F.

Figure 7:
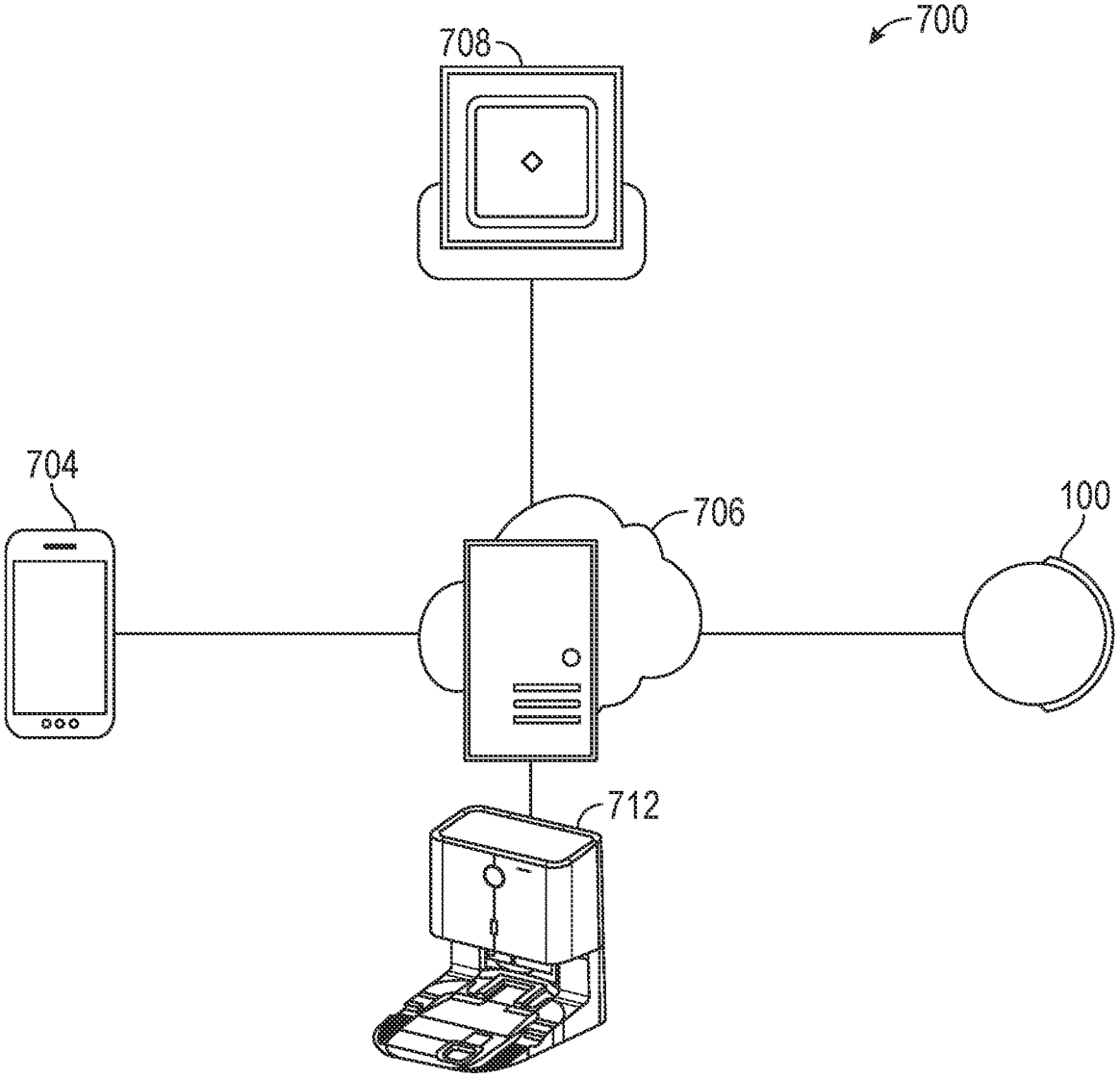
FIG. 7 illustrates schematic view of a mobile cleaning robot network.

In operation, the drive assembly (e.g., the drive assembly 142) can overcome the biasing force F to retract the cross shaft 144 to retract the dustpan 122, where the cross-shaft 144 can allow spring modules on both sides to be retracted at the same time. The dustpan 122 can also encounter obstacles in the environment that can overcome the force F to allow the dustpan 122 to move rearward during FIG. 7 illustrates schematic view of a mobile cleaning robot network 700 that enables networking between the mobile robot 100 and one or more other devices, such as a mobile device 704, a cloud computing system 706, another autonomous robot 708 separate from the mobile robot 100, or a docking station 712.

Using the communication network 700, the robot 100, the mobile device 704, the robot 708, and the cloud computing system 706 can communicate with one another to transmit and receive data from one another. In some examples, the robot 100, the docking station 712, or both the robot 100 and the docking station 712 communicate with the mobile device 704 through the cloud computing system 706. Alternatively, or additionally, the robot 100, the docking station 712, or both the robot 100 and the docking station 712 can communicate directly with the mobile device 704. Various types and combinations of wireless networks (e.g., Bluetooth, radio frequency, optical based, etc.) and network architectures (e.g., point-to-point or mesh networks) can be employed by the communication network 700.

In some examples, the mobile device 704 can be a remote device that can be linked to the cloud computing system 706 and can enable a user to provide inputs. The mobile device 704 can include user input elements such as, for example, one or more of a touchscreen display, buttons, a microphone, a mouse, a keyboard, or other devices that respond to inputs provided by the user. The mobile device 704 can also include immersive media (e.g., virtual reality) with which the user can interact to provide input. The mobile device 704, in these examples, can be a virtual reality headset or a head-mounted display.

The user can provide inputs corresponding to commands for the mobile robot 100. In such cases, the mobile device 704 can transmit a signal to the cloud computing system 706 to cause the cloud computing system 706 to transmit a command signal to the mobile robot 100. In some implementations, the mobile device 704 can present augmented reality images. In some implementations, the mobile device 704 can be a smart phone, a laptop computer, a tablet computing device, or other mobile device.

In some examples, the communication network 700 can include additional nodes. For example, nodes of the communication network 700 can include additional robots. Also, nodes of the communication network 700 can include network-connected devices that can generate information about the environment. Such a network-connected device can include one or more sensors, such as an acoustic sensor, an image capture system, or other sensor generating signals, to detect characteristics of the environment from which features can be extracted. Network-connected devices can also include home cameras, smart sensors, or the like.

In the communication network 700, the wireless links can utilize various communication schemes, protocols, etc., such as, for example, Bluetooth classes, Wi-Fi, Bluetooth-low-energy, also known as BLE, 802.15.4, Worldwide Interoperability for Microwave Access (WiMAX), an infrared channel, satellite band, or the like. In some examples, wireless links can include any cellular network standards used to communicate among mobile devices, including, but not limited to, standards that qualify as 1G, 2G, 3G, 4G, 5G, or the like. The network standards, if utilized, qualify as, for example, one or more generations of mobile telecommunication standards by fulfilling a specification or standards such as the specifications maintained by International Telecommunication Union. For example, the 4G standards can correspond to the International Mobile Telecommunications Advanced (IMT-Advanced) specification. Examples of cellular network standards include AMPS, GSM, GPRS, UMTS, LTE, LTE Advanced, Mobile WiMAX, and WiMAX-Advanced. Cellular network standards can use various channel access methods, e.g., FDMA, TDMA, CDMA, or SDMA.

According to some examples discussed herein, the robot 100 can be operated, such as by the controller 108, to drive a drive wheel (or the drive wheels 112) of the mobile cleaning robot 100 to navigate the mobile cleaning robot 100 about the environment 40. The robot 100 can be operated in two different modes during a cleaning operation. For example, the robot 100 can be operated in a mobility mode and a cleaning mode. In the mobility mode, the dustpan 122 can be in a retracted position and in the cleaning mode, the dustpan 122 can be in an extended position where the dustpan 122 can engage the floor surface 50 and the roller 118.

In operation, the controller 108 can operate the motor 143 of the drive assembly 142 to move the arms 148*a* and 148*b* to retract the dustpan 122 when the controller 108 determines that the mobility mode should be selected, such as when the controller 108 detects an obstacle to mobility, such as an ingestible object (e.g., cord or rug tassels), such as by using information from one or more sensors of the sensor system. In the mobility mode, the dustpan 122 can be moved relative to the body 102 to a retracted position. When in this position, the roller 118 can be used to, along with the drive wheels 112, help the robot 100 to more effectively traverse a mobility obstacle.

When the robot 100 (such as the controller 108) determines that the robot 100 should operate in the cleaning mode, the controller 108 can send instructions to the motor 143 of the drive assembly 142 to move the arms 148 and therefore the dustpan 122 with respect to the body 102 to extend such that the dustpan 122 can engage the floor surface 50 and the roller 118 to help direct debris into the suction duct 139 of the robot 100. Optionally, to move from the retracted mode to the cleaning mode, when the motor 143 is a quick-acting motor (e.g., solenoid), the motor 143 can release the arms 148 and the spring modules 146 can bias the arms 148 and the dustpan 122 to quickly return the dustpan 122 to its extended position for continued cleaning operations of the mobile cleaning robot 100.

Figure 8:
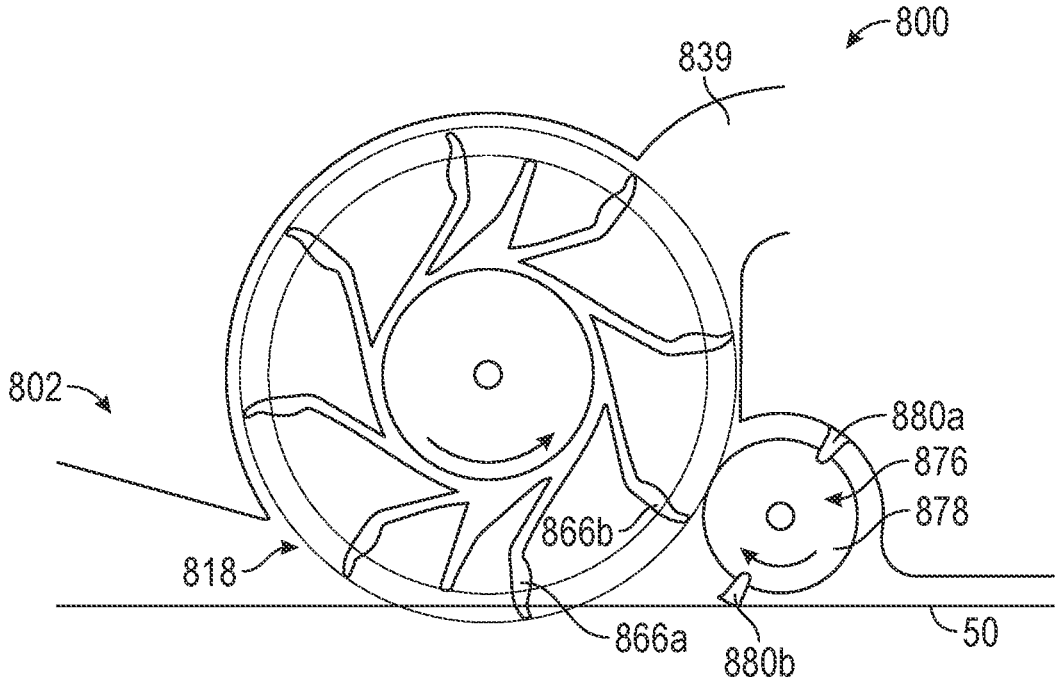
FIG. 8 illustrates a side view of a portion of a mobile cleaning robot.

FIG. 8 illustrates a side view of a portion of a mobile cleaning robot 800. The mobile cleaning robot 800 can be similar to the robot 100 discussed above; the robot 800 can differ in that the robot can include a rotating guide 876 instead of a dustpan. The robot 100 can be modified to include such a guide.

The rotating guide 876 can be connected to the body 802 and can be rotatable with respect to the body 802 and a roller 818. The rotating guide 876 can include a core 878 that can be solid, rigid, or semi-rigid and smooth to reduce friction between the core 878 and obstacles of the environment 40. The rotating guide 876 can also include brushes or bristles 880*a* and 880*b* that can be configured to engage the floor surface 50 and fletches 866 of the roller 818 of the robot 800. Though two bristles 880 are shown, the guide 876 can include 1, 3, 4, 5, 6, 8, 9, 10, or the like. Each bristle 880 can be a group of bristles. Optionally, the guide can be a fletched roller without bristles or can be covered in bristles such that groups of bristles are not defined.

The action between the fletches 866, the core 878 and the bristles 880 can help to direct debris from the floor surface 50 toward a suction duct 839. The rotating guide 876 can be a passively rotating guide, such as based on interaction with the roller 818 or the floor 50, or can be an actively rotating guide, such as to counterrotate with respect to the roller 818.

NOTES AND EXAMPLES

The following, non-limiting examples, detail certain aspects of the present subject matter to solve the challenges and provide the benefits discussed herein, among others.

Example 1 is a mobile cleaning robot comprising: a body including a suction duct; and a cleaning assembly operable to ingest debris from a surface of an environment, the cleaning assembly comprising: a dustpan engageable with the surface to direct debris toward the suction duct and movable with respect to the body; and a cleaning wheel rotatable with respect to the body and engageable with the surface and the dustpan to direct debris toward the suction duct.

In Example 2, the subject matter of Example 1 optionally includes wherein the dustpan is operable to move between an extended position and a retracted position.

In Example 3, the subject matter of Example 2 optionally includes a biasing member to bias the dustpan towards the extended position.

In Example 4, the subject matter of Example 3 optionally includes a drive assembly operable to move the dustpan between the extended position and the retracted position, wherein the drive assembly includes arms connected to the dustpan and movable together with the dustpan.

In Example 5, the subject matter of Example 4 optionally includes wherein the arms are individually flexible to allow asymmetrical movement of the dustpan with respect to the body.

In Example 6, the subject matter of Example 5 optionally includes wherein the drive assembly includes a cross-shaft connected to the arms and to a motor to allow the motor to drive extend and retract the arms together.

In Example 7, the subject matter of any one or more of Examples 1-6 optionally include wherein the dustpan includes a flexible member defining a leading edge engageable with the surface.

In Example 8, the subject matter of Example 7 optionally includes wherein the body includes a dustpan slot, the dustpan engageable with the slot to limit extension of the dustpan with respect to the body and the cleaning wheel.

In Example 9, the subject matter of Example 8 optionally includes wherein the flexible member is engageable with the slot when the dustpan is in the extended position.

In Example 10, the subject matter of any one or more of Examples 8-9 optionally include wherein the dustpan slot is formed at least in part by a sled of the body.

In Example 11, the subject matter of any one or more of Examples 1-10 optionally include wherein the dustpan is movable with respect to the body and the cleaning wheel.

Example 12 is a mobile cleaning robot comprising: a vacuum system operable to ingest debris from an environment; a body including a suction duct connected to the vacuum system; and a cleaning assembly operable to clean a surface of the environment, the cleaning assembly comprising: a guide engageable with the surface to direct debris toward the suction duct; and an extractor rotatable with respect to the body and engageable with the surface and the guide to direct debris toward the suction duct.

In Example 13, the subject matter of Example 12 optionally includes wherein the guide is operable to move between an extended position and a retracted position.

In Example 14, the subject matter of Example 13 optionally includes a biasing member to bias the guide towards the extended position.

In Example 15, the subject matter of Example 14 optionally includes a drive assembly operable to move the guide between the extended position and the retracted position, wherein the drive assembly includes arms connected to the guide and movable together with the dustpan.

In Example 16, the subject matter of Example 15 optionally includes wherein the arms are individually flexible to allow asymmetrical movement of the guide with respect to the body.

In Example 17, the subject matter of Example 16 optionally includes wherein the body defines a guide slot, the guide engageable with the slot to limit extension of the guide with respect to the body and the cleaning wheel and to seal the guide slot.

Example 18 is a mobile cleaning robot comprising: a body including a suction duct; and a cleaning assembly operable to ingest debris from a surface of an environment, the cleaning assembly comprising: a dustpan engageable with the surface to direct debris toward the suction duct; and a cleaning wheel rotatable with respect to the body and engageable with the surface and the dustpan to direct debris toward the suction duct.

In Example 19, the subject matter of Example 18 optionally includes wherein the dustpan includes a flexible member defining a leading edge engageable with the surface.

In Example 20, the subject matter of Example 19 optionally includes wherein the body defines a dustpan slot, the dustpan engageable with the slot when the dustpan is in the extended position to limit extension of the dustpan with respect to the body and the cleaning wheel and to seal the dustpan slot.

In Example 21, the subject matter of Example 20 optionally includes wherein the dustpan slot is formed at least in part by a sled of the body.

Example 22 is a method of operating a mobile cleaning robot comprising: operating a drive wheel of the mobile cleaning robot to navigate the mobile cleaning robot about the environment; moving a dustpan relative to a body of the mobile cleaning robot to a retracted position, to operate the mobile cleaning robot in a mobility mode; extending the dustpan relative to the body to operate the mobile cleaning robot in a cleaning mode; and operating a cleaning assembly to ingest debris from a surface of an environment in the cleaning mode.

In Example 23, the subject matter of Example 22 optionally includes engageable the dustpan with the surface in the cleaning mode to direct debris toward the suction duct.

In Example 24, the subject matter of Example 23 optionally includes rotating a cleaning wheel of the cleaning assembly with respect to the body to engage the surface and the dustpan to direct debris toward the suction duct.

In Example 25, the subject matter of any one or more of Examples 22-24 optionally include wherein the dustpan includes a flexible member defining a leading edge engageable with the surface.

In Example 26, the apparatuses or method of any one or any combination of Examples 1-25 can optionally be configured such that all elements or options recited are available to use or select from.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. A mobile cleaning robot comprising:
- a body including a suction duct; and
- a cleaning assembly operable to ingest debris from a surface of an environment, the cleaning assembly comprising:
  - a dustpan engageable with the surface to direct debris toward the suction duct and movable with respect to the body;
  - a biasing member to bias the dustpan towards the extended position; and
  - a cleaning wheel rotatable with respect to the body and engageable with the surface and the dustpan to direct debris toward the suction duct.

2. The mobile cleaning robot of claim 1, wherein the dustpan is operable to move between an extended position and a retracted position.

3. The mobile cleaning robot of claim 1, further comprising:
- a drive assembly operable to move the dustpan between the extended position and the retracted position, wherein the drive assembly includes arms connected to the dustpan and movable together with the dustpan.

4. The mobile cleaning robot of claim 3, wherein the arms are individually flexible to allow asymmetrical movement of the dustpan with respect to the body.

5. The mobile cleaning robot of claim 4, wherein the drive assembly includes a cross-shaft connected to the arms and to a motor to allow the motor to drive extend and retract the arms together.

6. The mobile cleaning robot of claim 1, wherein the dustpan includes a flexible member defining a leading edge engageable with the surface.

7. The mobile cleaning robot of claim 6, wherein the body includes a dustpan slot, the dustpan engageable with the slot to limit extension of the dustpan with respect to the body and the cleaning wheel.

8. The mobile cleaning robot of claim 7, wherein the flexible member is engageable with the slot when the dustpan is in the extended position.

9. The mobile cleaning robot of claim 7, wherein the dustpan slot is formed at least in part by a sled of the body.

10. The mobile cleaning robot of claim 1, wherein the dustpan is movable with respect to the body and the cleaning wheel between the extended position where the dustpan is engageable with the cleaning wheel and between the retracted position where the dustpan is disengaged from the cleaning wheel.

11. A mobile cleaning robot comprising:
- a vacuum system operable to ingest debris from an environment;
- a body including a suction duct connected to the vacuum system; and
- a cleaning assembly operable to clean a surface of the environment, the cleaning assembly comprising:
  - a guide engageable with the surface to direct debris toward the suction duct;
  - a biasing member to bias the dustpan relative to the body and the cleaning wheel towards the extended position; and
  - an extractor rotatable with respect to the body and engageable with the surface and the guide to direct debris toward the suction duct.

12. The mobile cleaning robot of claim 11, wherein the guide is operable to move between an extended position and a retracted position.

13. The mobile cleaning robot of claim 11, further comprising:
- a drive assembly operable to move the guide between the extended position and the retracted position, wherein the drive assembly includes arms connected to the guide and movable together with the guide.

14. The mobile cleaning robot of claim 13, wherein the arms are individually flexible to allow asymmetrical movement of the guide with respect to the body.

15. The mobile cleaning robot of claim 14, wherein the body defines a guide slot, the guide engageable with the slot to limit extension of the guide with respect to the body and the cleaning wheel and to seal the guide slot.

16. A mobile cleaning robot comprising:
- a body including a suction duct; and
- a cleaning assembly operable to ingest debris from a surface of an environment, the cleaning assembly comprising:
  - a dustpan engageable with the surface to direct debris toward the suction duct;
  - a biasing element connected to the body and connected to the dustpan, the biasing element configured to bias the dustpan relative to the body and relative to the cleaning wheel; and
  - a cleaning wheel rotatable with respect to the body and engageable with the surface and the dustpan to direct debris toward the suction duct.

17. The mobile cleaning robot of claim 16, wherein the dustpan includes a flexible member defining a leading edge engageable with the surface.

18. The mobile cleaning robot of claim 17, wherein the body defines a dustpan slot, the dustpan engageable with the slot when the dustpan is in an extended position to limit extension of the dustpan with respect to the body and the cleaning wheel and to seal the dustpan slot.

19. The mobile cleaning robot of claim 18, wherein the dustpan slot is formed at least in part by a sled of the body.

* * * * *